US006179553B1

(12) United States Patent
Liegat

(10) Patent No.: US 6,179,553 B1
(45) Date of Patent: Jan. 30, 2001

(54) MULTIPLE STAGE CENTRIFUGAL PUMP

(75) Inventor: Siegfried Liegat, Bruchsal (DE)

(73) Assignee: Sulzer Weise GmbH, Bruchsal (DE)

( * ) Notice: Under 35 U.S.C. 154(b), the term of this patent shall be extended for 0 days.

(21) Appl. No.: 09/273,400

(22) Filed: Mar. 22, 1999

(30) Foreign Application Priority Data

Mar. 30, 1998 (EP) ..... 98810274

(51) Int. Cl.[7] ..... F01D 1/24
(52) U.S. Cl. ..... 415/61; 415/69; 415/124.1
(58) Field of Search ..... 415/60, 61, 62, 415/68, 69, 124.1, 122.1, 143; 416/197 C, 180

(56) References Cited

U.S. PATENT DOCUMENTS 4,190,395 2/1980 Ball ..... 415/61
4,780,066 * 10/1988 Bolleter et al. ..... 417/420

FOREIGN PATENT DOCUMENTS 442999 1/1968 (CH) .
21611 of 1912 (GB) .

OTHER PUBLICATIONS

Baibakov, O.V., et al., "Better power/ speed cavitation for centrifugal pumps" in *Russian Engineering Journal*, vol. 53, No. 11, 1973, pp. 31–35.
Dornaus, W.L. "New Ideas needed for the NPSH problem", in *Power*, Jun. 1970, p. 74.

* cited by examiner

*Primary Examiner*—Edward K. Look
*Assistant Examiner*—Hermes Rodriguez
(74) *Attorney, Agent, or Firm*—Townsend and Townsend & Crew LLP

(57) ABSTRACT

Multiple stage centrifugal pumps have a plurality of rotors arranged on a drive shaft are shown. At least one rotor is formed as a hollow shaft which is rotatably journalled on the drive shaft and which rotates with a speed of rotation $n_2$ which is different from the speed of rotation $n_1$ of the drive shaft. The hollow shaft is driven by a mechanical converter which takes up mechanical power from the drive shaft in the housing and gives it off at a different speed of rotation $n_2$ to the hollow shaft in such a manner that the speed of rotation of a rotor of the first stage is lower in order to produce a lower $NPSH_R$ value for the multiple stage pump.

5 Claims, 7 Drawing Sheets

MULTIPLE STAGE CENTRIFUGAL PUMP

BACKGROUND OF THE INVENTION

The invention relates to a multiple stage centrifugal pump for liquids with a plurality of rotors which are arranged on a shaft and which rotate in a pump housing.

Multiple stage centrifugal pumps are used when it is desired to produce a high pressure gradient and the required forwarding amounts or the nature of the forwarded medium is such that volumetric pumps do not come under consideration. A pump manufacturer will thus first attempt to manage with few pump stages and to make the peripheral speed or the speed of rotation of such a pump large. However, high entry accelerations arise in the rotor at the suction side of the pump at the first stage, which leads to cavitation when the net positive suction head available ($NPSH_A$) in the installation, in which the pump is set up at the momentary forwarding amount, is not greater than the net positive suction head required ($NPSH_R$), which is required according to the pump characteristic. The value of a pump thus essentially depends on its $NPSH_R$ value being as low as possible in order that too great a demand is not placed on the plant constructor due to the magnitude of the net positive suction head.

These relationships are described in detail in the Centrifugal Pump Handbook (1st edition, July 1985 by Gebr üder Sulzer AG, 8401 Winterthur, Switzerland) in Chapter 1.5 "Kavitation und Saugverhalten". The following are named as means for the improvement of the suction capacity or of the speed of rotation:

a) Use of special suction wheels in the most varied forms.

b) Use of a doubly fluted rotor as 1st stage.

c) Supplementary rotor.

d) Auxiliary or feeder pump.

Measures b) and d) signify considerable additional costs on pump manufacture, whereas measures a) and c) signify a restriction in the characteristic field since an optimization can actually take place only for one design point of a characteristic.

SUMMARY OF THE INVENTION

The object of the invention is thus to modify a multiple stage pump in such a manner that it can be driven at low $NPSH_A$ values of a plant permissible characteristic range.

This object is satisfied in that at least one rotor is journalled on the drive shaft as a hollow shaft and rotates with a speed of rotation $n_2$ which is different from the speed of rotation $n_1$ of the drive shaft, with the hollow shaft being driven by a mechanical converter which takes up mechanical power from the drive shaft in the housing and gives it off to the hollow shaft at this different speed of rotation $n_2$ in such a manner that the speed of rotation of the first rotor is lower in order to produce a lower $NPSH_R$ value for the multiple stage pump.

Thus, it is advantageous to execute the mechanical converter as a transmission with a fixed transmission ratio, with planetary transmissions being suitable. In order to reduce the relatively high losses which result in a mechanical toothing, a magnetic gearing or meshing is proposed. Instead of a wreath of teeth, cylindrical rings are provided which consist of permanent magnets which are arranged in layers over the periphery of a ring with alternating polarity. Since the division for the change of polarity is kept the same on the different cylinders, the oppositely disposed different polarities mesh like gears and can transmit torques. The drag losses and the noise production are substantially less than in fluted gear transmissions.

In multiple stage pumps with a large forwarding flow it is advantageous to design the first rotor as a hollow shaft journalled on the drive shaft and to drive the first rotor at a lower speed of rotation $n_2<n_1$ with the mechanical converter.

In multiple stage pumps with a small forwarding flow and a large forwarding height it can be advantageous due to the investment costs of the pump and drive aggregate to attach the first rotor rigidly to the drive shaft and to journal further stages as a hollow shaft on the drive shaft. A planetary transmission must then drive the hollow shaft with a speed of rotation of $n_2>n_1$.

For the cases with a lower speed of rotation $n_2$ of the first rotor with respect to the speed of rotation $n_1$ of the drive shaft the mechanical converter can also be designed as a torque converter with slip, similarly to a liquid or hydraulic couping. Likewise it is conceivable to provide a turbine wheel additionally on the hollow shaft and to feed the latter with a partial flow from a later stage and to admix this partial flow to the flow on the suction side.

A further advantage consists in that the improved suction capacity is bought with a smaller enlargement of the constructional volume. In addition no feeder pump is required. A further advantage results for condensate pumps. When these are constructed vertically, they must usually run at a low speed of rotation, which requires more stages in order to arrive at the predetermined final pressure. Through the proposed improvement these pumps can be built with fewer stages and smaller installation depth, which considerably saves construction costs. In addition these measures are also effective for horizontally arranged pumps.

DESCRIPTION OF THE SPECIFIC EMBODIMENTS

Multiple stage centrifugal pumps which have a plurality of rotors arranged on a drive shaft are shown in FIGS. 1 to 4. The rotor of the first stage is formed as a hollow shaft which is rotatably journalled on the drive shaft. With the rotation of the drive shaft, mechanical work is given off to a mechanical converter which imparts a torque to the hollow shaft at a speed of rotation $n_2$ which is lower than the speed of rotation $n_1$ of the drive shaft in order to produce a lower entry acceleration of the incoming liquid and a lower $NPSH_R$ value for the multiple stage pump. It is evident that for reasons of continuity, the flow cross-sections should be chosen larger in the first rotor when its speed of rotation is lower than that of the following rotors in order to achieve a forwarding region which is equally as large as in the stages with a high speed of rotation.

Figure 5A:
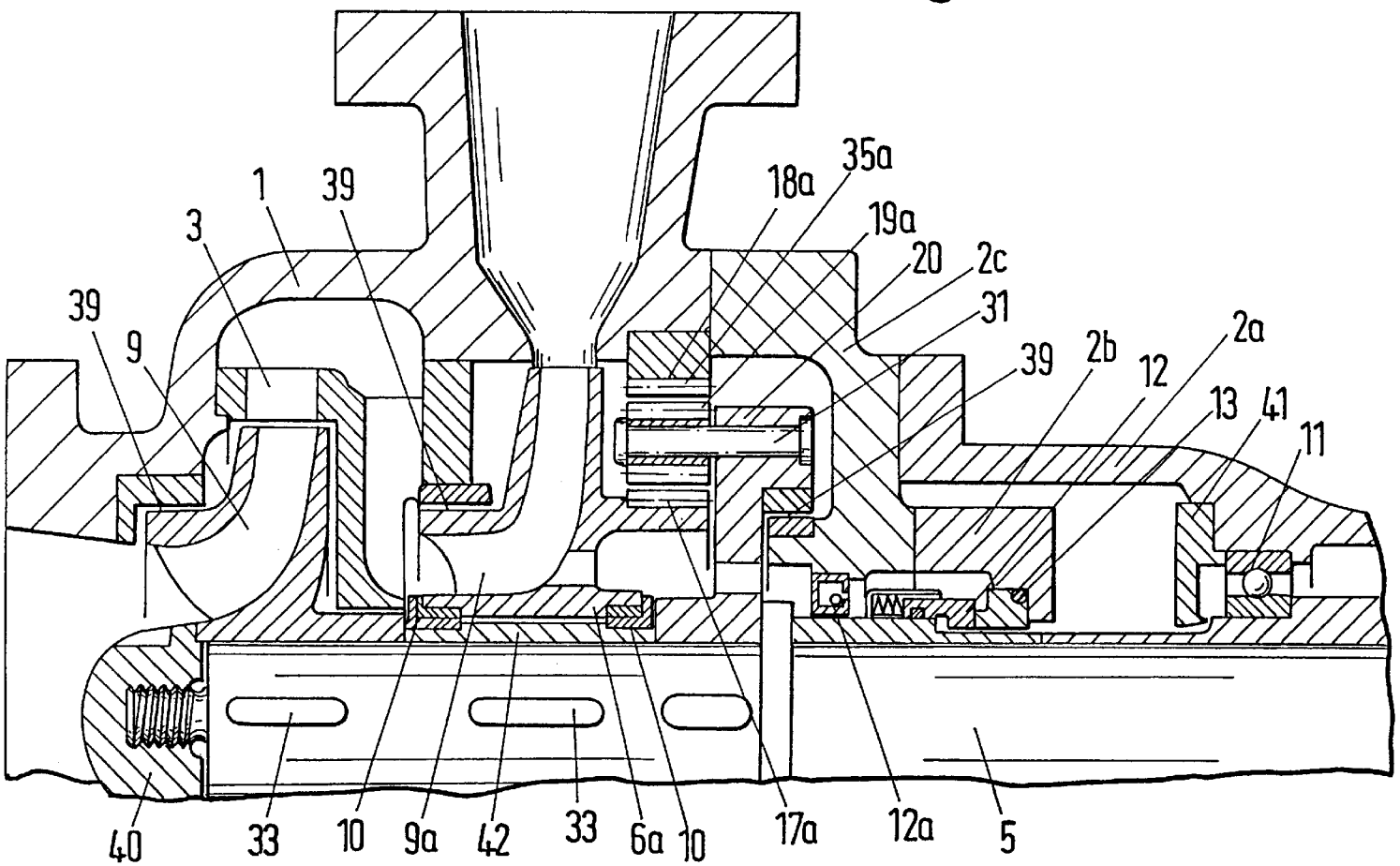
FIG. 5*a* is a cross-sectional view showing, schematically, a section of a two stage centrifugal pump of which the first rotor is rigidly coupled to the drive shaft, whereas the second rotor is journalled on the drive shaft as a hollow shaft and is brought to a substantially higher speed of rotation within the housing by a magnetically meshed planetary transmission.
Figure 5B:
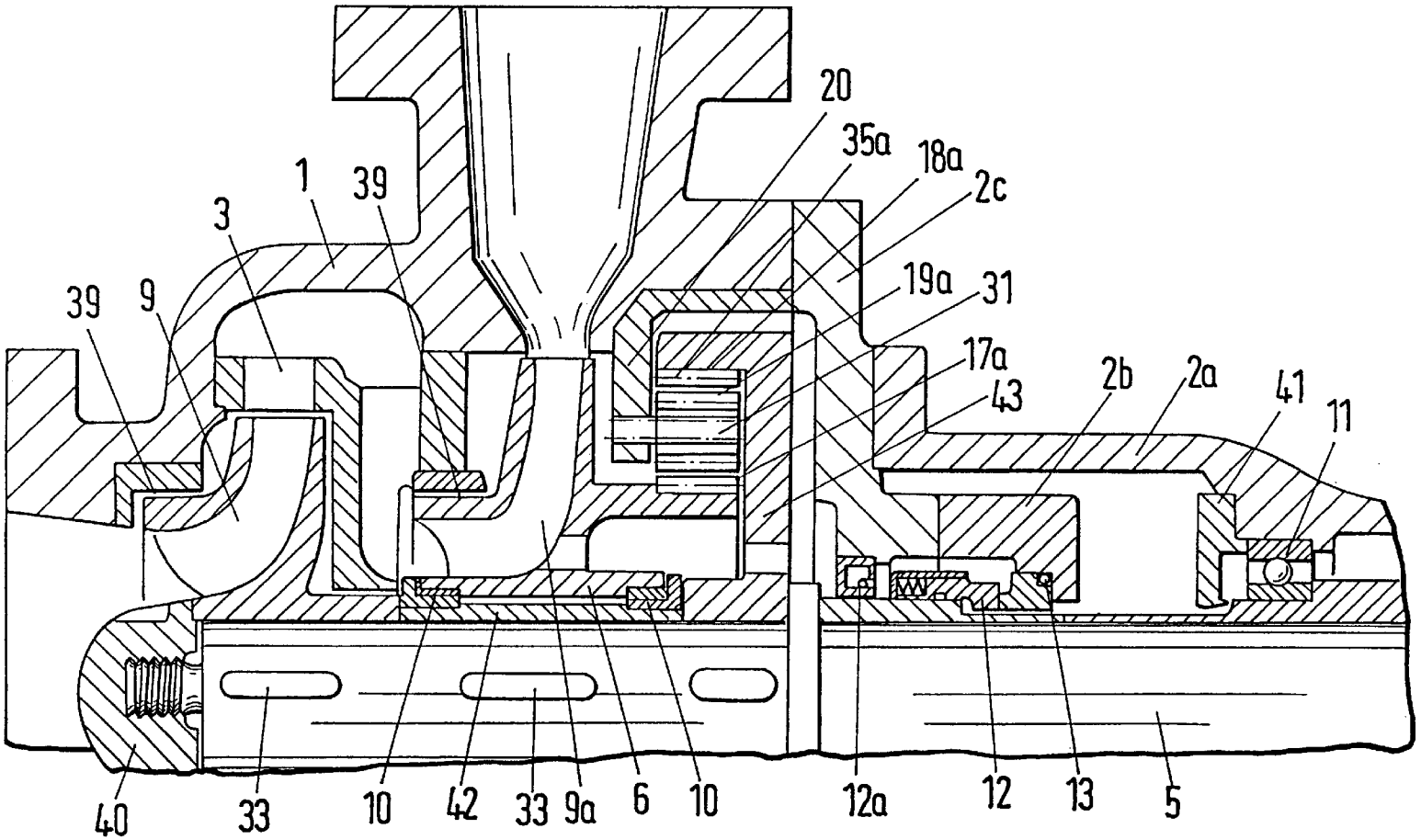
FIG. 5*b* is a cross-sectional view showing, schematically, an arrangement as in FIG. 5*a*, with the drive shaft and the second rotor rotating in the opposite direction.

In FIGS. 5*a*, 5*b* the rotor of the second stage rotates with a speed of rotation $n_2$, which is much greater than the speed of rotation $n_1$ of the drive shaft, because an increase in the speed of rotation takes place inside the pump housing with a planetary transmission. There arises a large pressure increase in the second stage, whereas the first stage, which rotates at a drive speed of rotation $n_1$ achieves a favourable $NPSH_R$ value.

In the following examples the same reference symbols have been used for the same objects.

Figure 1A:
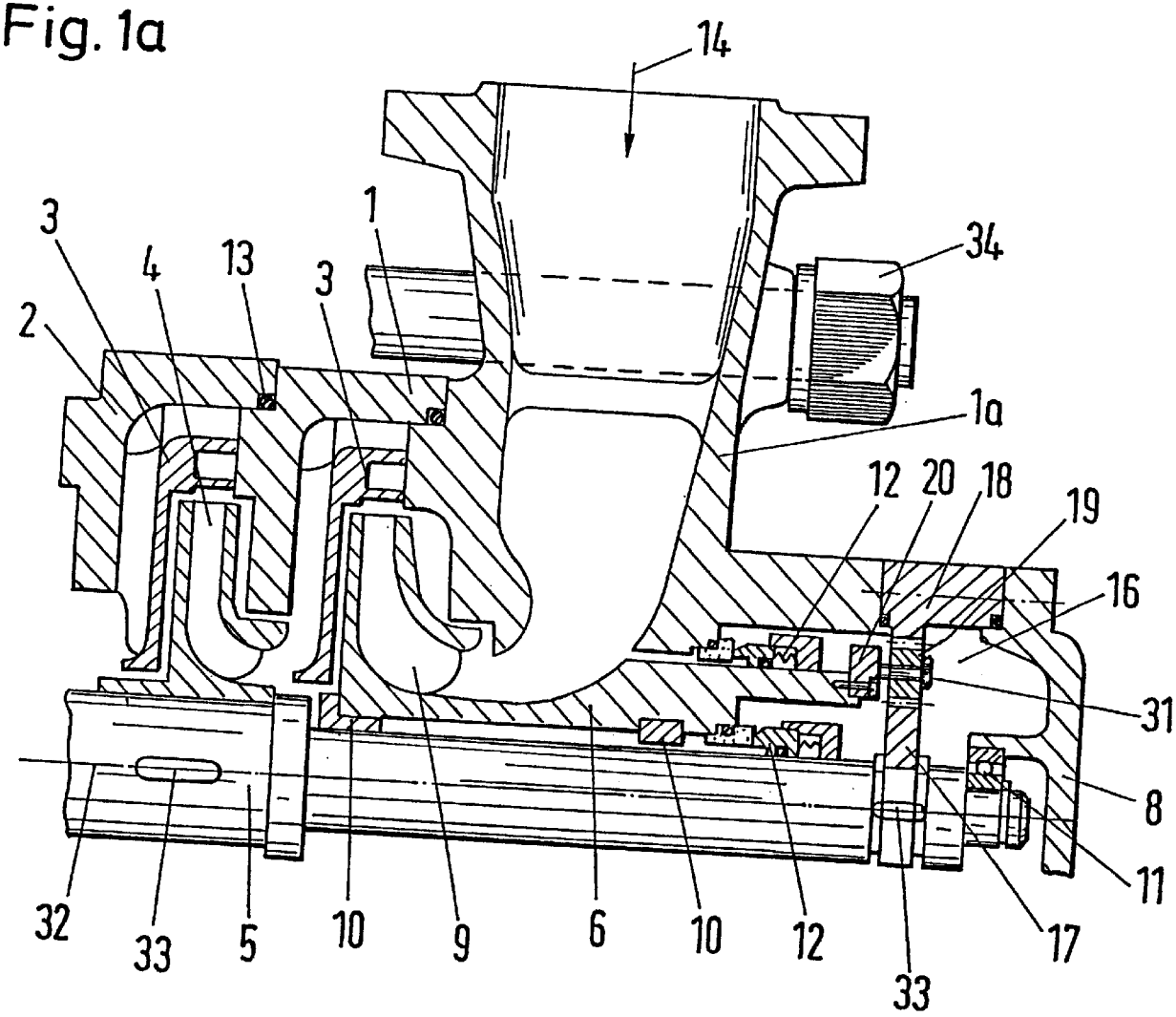
FIG. 1*a* is a cross-sectional view showing, schematically, a section of a multiple stage pump with a planetary transmission between the drive shaft and the first rotor, with the drive shaft and a first rotor rotating in the same direction.
Figure 1B:
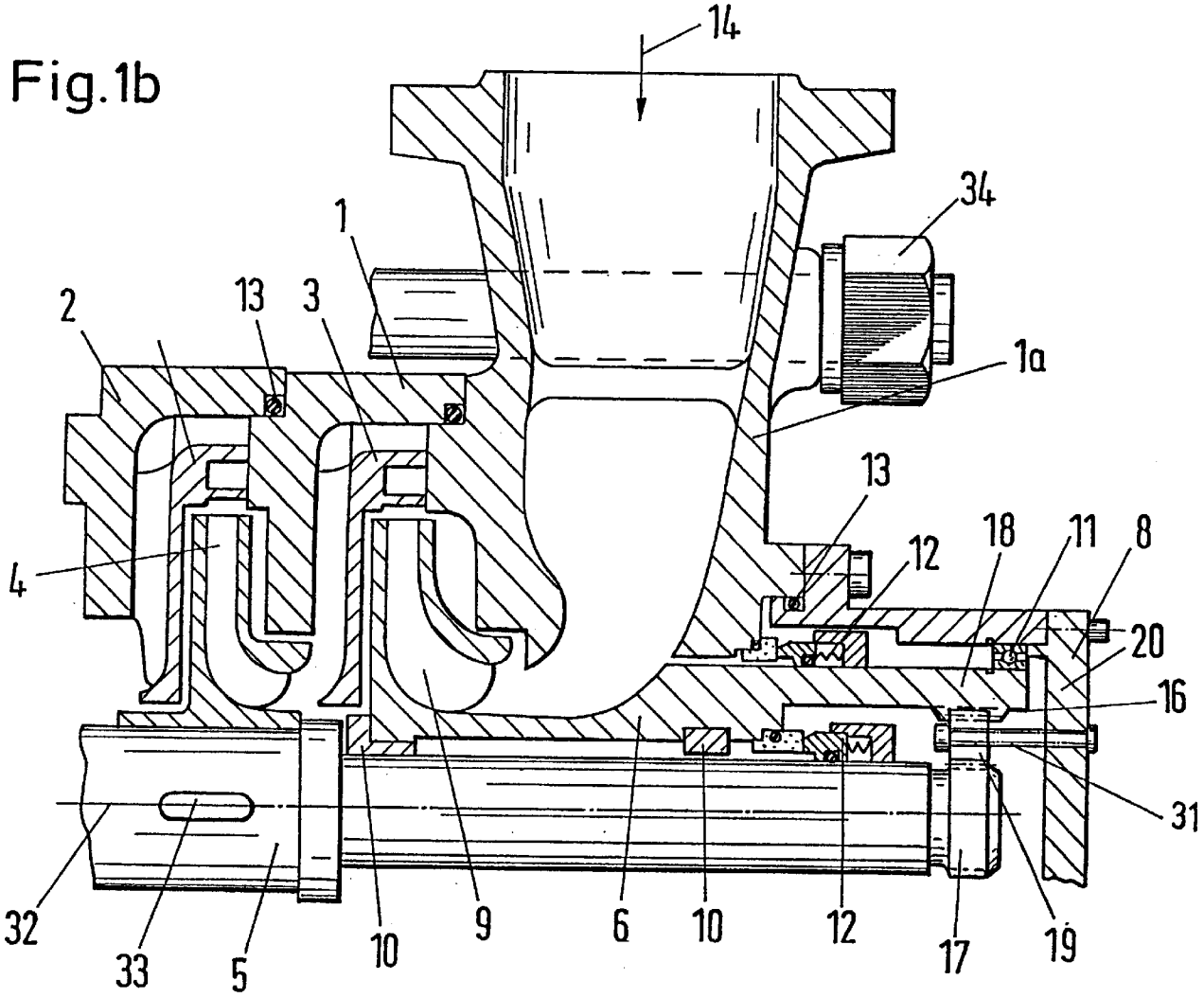
FIG. 1*b* is a cross-sectional view showing, schematically, an arrangement as in FIG. 1*a* with the drive shaft and the first rotor rotating in opposite directions.

In FIGS. 1*a*, 1*b*, guide rotors 3 which divert the liquid in each case to a following stage are enclosed in a pump housing 1, 1*a*, 2. The associated rotors 9, 4 are positioned on the drive shaft 5, with the rotor 9 of the first stage being rotatably journalled as a hollow rotor 6 on the drive shaft 5 with bearings 10. The hollow rotor 6 reaches beyond the intake spiral on the suction side in the axial direction and is sealed against the housing 1*a* and against the shaft 5 via dynamic shaft seals 12. Behind the shaft seals 12 a planetary transmission 16 is integrated into the pump housing 1*a*.

In the case of FIG. 1*a* the space of the planetary transmission 16 has an oil filling, which is sealed against the forwarding liquid via the shaft seals 12. A planetary carrier 20 is secured as a ring on the hollow shaft 6 and carries with planetary bolts 31 the planetary wheels 19, which engage on the outer side into an outer wreath 18 which is connected to the housing and on the inner side into a sun wheel 17. In this way a stepped down speed of rotation $n_2$ results for the first rotor 9 which is less than half the speed of rotation $n_1$ of the drive shaft 5. The exact speed-of-rotation ratio is adapted to the ideal operating conditions through the dimensioning of the sun and the planetary wheels. The drive shaft 5 is supported on the suction side in its axle 32 by a roller bearing 11 at the housing cover 8. The rotors 4 after the 1st stage and the sun wheel 17 are connected to the shaft 5 in a form locked manner by means of feather keys 33. The housing parts 1, 1*a*, 2, 8 are sealed relative to one another via static seals 13.

In the case of FIG. 1*b* the functions of the planetary transmission 16 are reversed with respect to FIG. 1*a*. The housing cover 8 serves at the same time as a planetary carrier 20, which holds the planetary wheels 19 at a fixed location with planetary bolts 31, whereas the outer tooth wreath 18 is provided at the hollow shaft 6 and the sun wheel 17 is provided at the drive shaft 5. In this arrangement the hollow shaft 6 rotates not only at a lower speed of rotation $n_2$ but also in the direction opposite to the speed of rotation $n_1$ of the drive shaft. The difference of the peripheral speeds at the bearings 10 and dynamic shaft seals 12 is relatively large. The hollow shaft 6, which itself has a bearing 11 to the housing, also forms a support for the drive shaft 5 via the bearings 10 at the suction side. The housing 1 is assembled from a plurality of housing parts 1*a*, 2 and is held together by tie rods 34.

Figure 2:
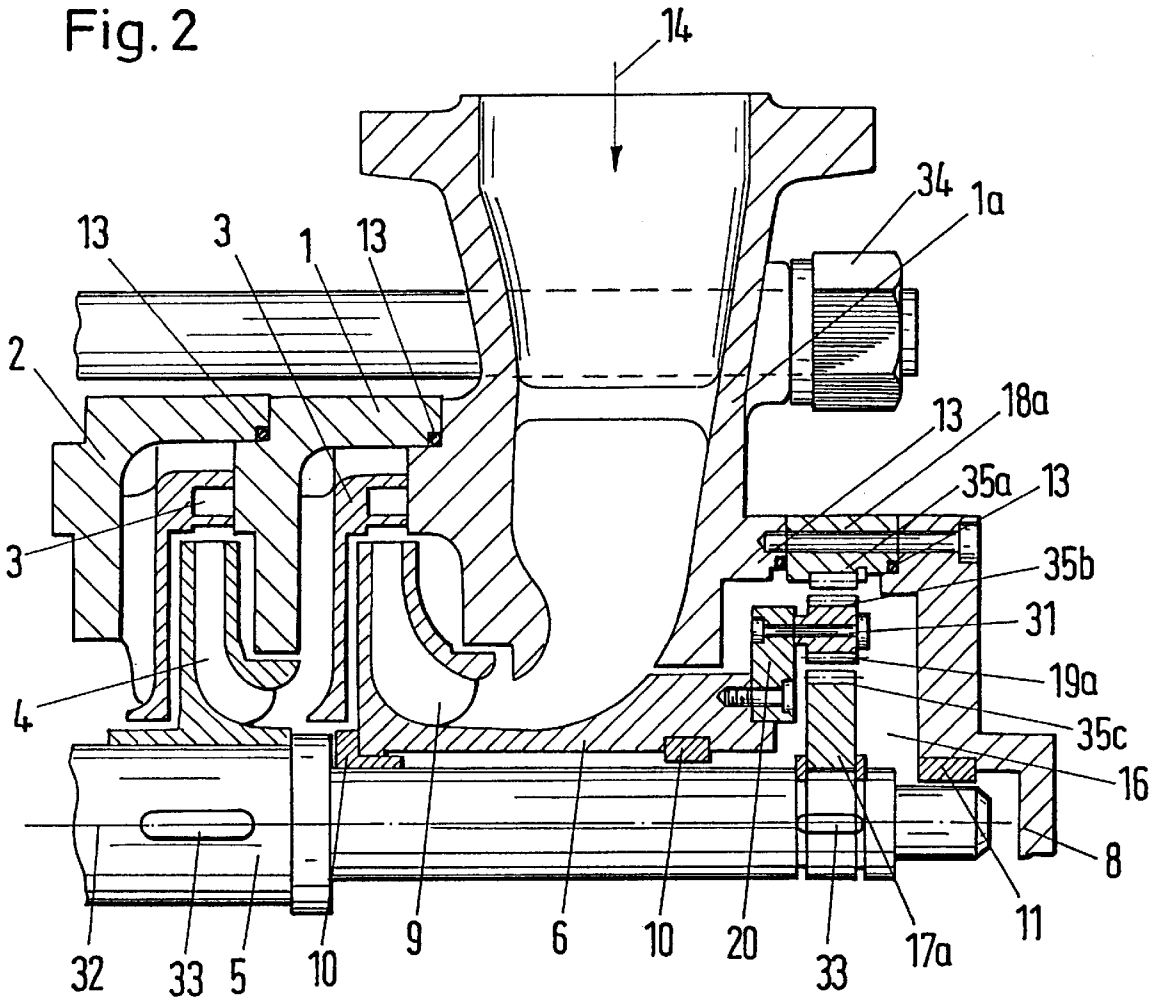
FIG. 2 is a cross-sectional view showing, schematically, an arrangement as in FIG. 1*a* in which the gears are replaced by a contact-less magnetic meshing.

The example of FIG. 2 differs from that of FIG. 1*a* in that the planetary transmission 16 is not realized with actual gears, but that instead of the gears the wheels 17*a*, 18*a*, 19*a* are equipped with permanent magnets 35*a, b, c* which relieve one another with alternating polarity at the periphery in order to form a contact-less, magnetic meshing. Since the wheels 17*a*, 18*a*, 19*a* do not touch one another, they may be wetted by the same liquid—in this case by the forwarding liquid—as the bearings 10, 11, which makes dynamic shaft seals superfluous.

Figure 3:
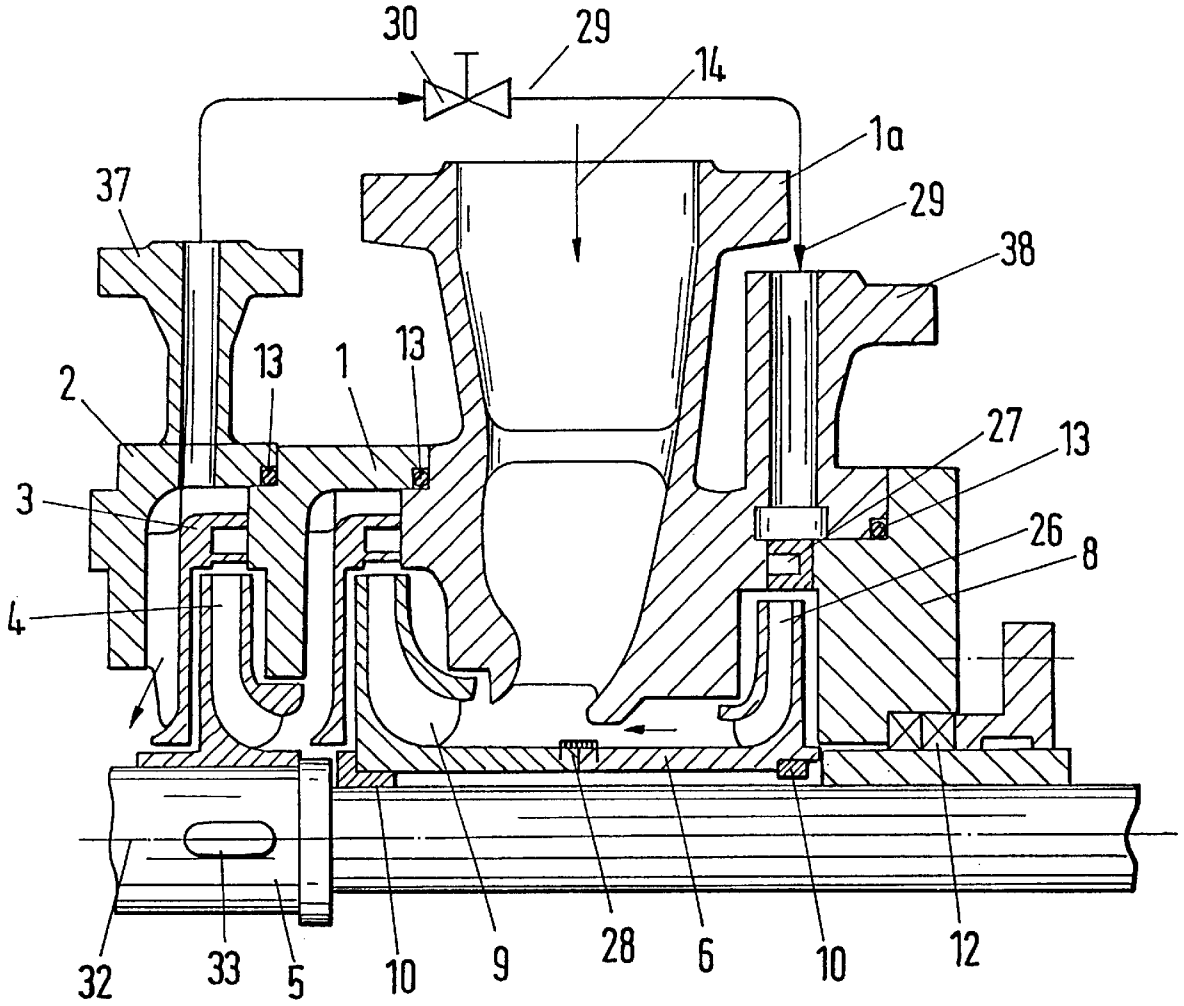
FIG. 3 is a cross-sectional view showing, schematically, a section of a multiple stage pump with a hydraulic drive of the 1st rotor by a turbine wheel which is driven via a partial flow of the liquid forwarded by the drive shaft.

In the example of FIG. 3 a hollow shaft 6 which is assembled with a connection piece 28 is rotatably journalled on a drive shaft 5 with bearings 10. After the second stage 4, 3 a partial flow 29 is branched off with a flange 37 at a higher pressure and is conveyed via a regulation member 30 and a further connection piece 38 to the suction side via a guide apparatus 27 to a turbine wheel 26 which is a constituent of the hollow shaft 6. At the outlet of the turbine wheel 26 the partial flow 29 is admixed to the suction flow ahead of the first rotor 9. In accordance with the characteristic of the turbine wheel 26 a speed of rotation $n_2$ which is variable via the regulation member 30 at a certain operating point of the pump sets in at a certain pressure gradient via the partial flow 29 corresponding to the torque at the first rotor. It is thus possible to associate to certain operating points a speed of rotation $n_2$ of the first rotor which leads to low $NPSH_R$ values for the pump.

Figure 4:
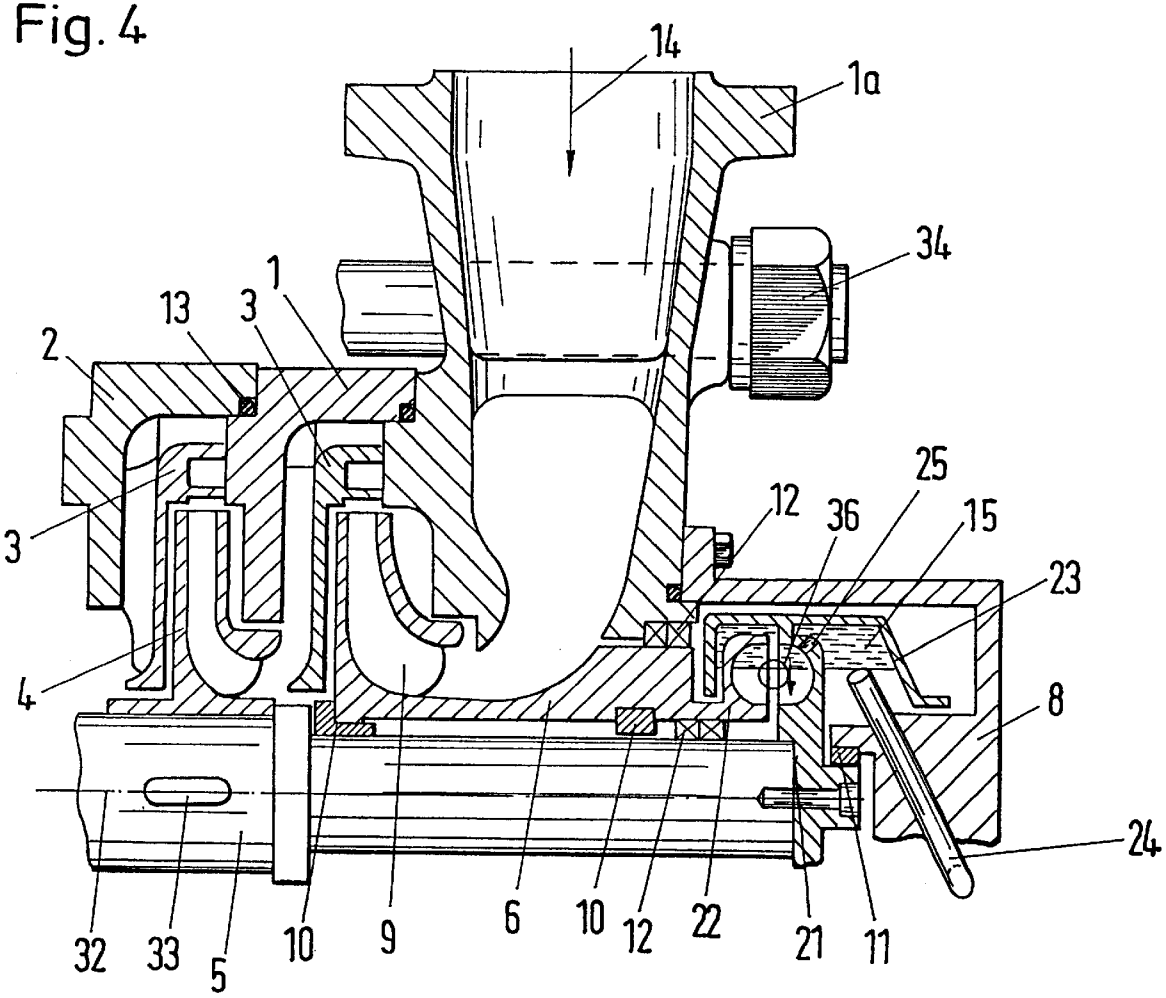
FIG. 4 is a cross-sectional view showing, schematically, a section of a multiple stage pump in which the first rotor experiences a torque from the drive shaft which is independent of the difference speed of rotation via the hydraulic coupling.

In the example of FIG. 4 a hydraulic coupling, which, as a torque/speed-of-rotation converter, gives off torque from the drive shaft 5 at a lower speed of rotation $n_2$ to the 1st rotor with a slip, is installed between the hollow shaft 6 and the drive shaft 5. Shaft seals 12 prevent greater amounts of forwarding liquid from entering into the region of the torque converters 21, 22. A converter part 21 which is connected to the drive shaft 5 is designed as a ring shaped tub 23 in which liquid lies as a ring at the base as a result of the centrifugal force. The level of this liquid ring is determined from the outside by a radially displaceable draw tube 24. Through bores 25 liquid enters into the space between the two bladed converter halves 21, 22 and forms a liquid flow 36 which circulates in the shape of a spiral between the two converter halves 21, 22 and gives off a certain torque from the rapidly rotating drive shaft 5 at a lower speed of rotation $n_2$ to the first rotor 9. Since for a given speed of rotation $n_2$ the level of the liquid in the tub 23 is responsible for the torque which can be transmitted, the position of the draw tube can be associated with the operating points of the pump characteristic in such a manner that lower $NPSH_R$ values arise. Into the space between the housing cover 8 and the shaft bearing 11 lubricating fluid is continuously supplied, which enters into the tub 23 and leads to a continuous flow through the draw tube 24, which permits a level regulation in both directions.

In the example of FIG. 5*a* the first rotor 9 is rigidly connected to the drive shaft 5. The second rotor 9*a* is journalled with bearings 10 on a sleeve 42 which is likewise rigidly connected to the drive shaft 5; a planetary carrier 20 is likewise connected via feather keys 33 to the shaft. A rotor nut 40 secures the three bodies 9, 9*a*, 20 axially. In the pump housing 1 a guide rotor 3 is anchored which is combined with the second stage by deflection passages. On a shoulder of the second rotor 9*a* a central wheel 17*a* which is equipped with permanent magnets is fastened which magnetically engages with a plurality of planetary wheels 19*a* which are arranged over the periphery. The planetary wheels 19*a* rotate on planetary bolts 31, which are connected to the planetary carrier 20. The permanent magnets of the planetary wheels

19*a* also engage magnetically with the permanent magnets 35*a* of an outer wreath 18*a* which is rigidly connected to the pump housing 1.

Subsequent housings 2*c*, 2*b* accommodate a lip seal 12*a* and a sliding ring seal 12. In a following bearing seat 2*a* the shaft 5 is journalled via bearings 11 and secured with a cover 41. Sealing gaps 39 between the housing and the rotating parts are chosen in such a manner that axial thrusts are largely compensated at the shaft 5. The remaining axial thrust is taken up by ball bearings 11.

In the example of FIG. 5*b*, merely the functions of the outer wreath 18*a* and the planetary carrier 20 are reversed with respect to FIG. 5*a*. The planetary carrier 20 is rigidly connected to the housing 1, whereas the outer wreath 18*a* is rigidly connected to the drive shaft 5 via a disc 43. In this arrangement the second rotor 9*a* rotates substantially more rapidly than the drive shaft, but in the opposite direction of rotation.

What is claimed is:

1. A multiple stage centrifugal pump for liquids comprising:

a plurality of rotors arranged on a drive shaft for rotation within a pump housing, the plurality of rotors including a rotor of a first stage of the pump, the rotor of the first stage of the pump being journalled on the drive shaft as a hollow shaft; and a mechanical converter for taking up mechanical power from the drive shaft to drive the hollow shaft at a fixed transmission ratio to produce a speed of rotation $n_2$ of the hollow shaft, which is lower than the speed of rotation $n_1$ of the drive shaft, thereby producing a lower $NPSH_R$ value for the multiple stage pump, the mechanical converter comprising a planetary transmission with a central gear connected to the drive shaft and a planetary carrier or an outer wreath connected to the hollow shaft.

2. A centrifugal pump according to claim 1 wherein the planetary transmission has contact-less meshing provided by permanent magnets.

3. A multiple stage centrifugal pump for liquids comprising:

a plurality of rotors arranged on a drive shaft for rotation within a pump housing, the plurality of rotors including a rotor of a first stage of the pump and at least one following rotor, the rotor of the first stage of the pump being rigidly connected to the drive shaft, the following rotor being journalled on the drive shaft as a hollow shaft; and a mechanical converter for taking up mechanical power from the drive shaft to drive the hollow shaft at a fixed transmission ratio to produce a speed of rotation $n_2$ of the hollow shaft, which is higher than the speed of rotation $n_1$ of the drive shaft, the mechanical converter comprising a planetary transmission with a central gear connected to the hollow shaft and a planetary carrier or an outer wreath rigidly connected to the drive shaft.

4. Centrifugal pump according to claim 3 wherein the planetary transmission has contact-less meshing provided by permanent magnets.

5. A multiple stage centrifugal pump for liquids comprising a plurality of rotors arranged on a drive shaft for rotation within a pump housing, the plurality of rotors including a rotor of a first stage of the pump, the rotor of the first stage of the pump being journalled on the drive shaft as a hollow shaft having a turbine wheel, the turbine wheel configured to be driven by a partial flow which is branched off from a stage following the first stage of the pump and is regulated by a regulation member to rotate the hollow shaft with a speed of rotation $n_2$, which is lower than the speed of rotation $n_1$ of the drive shaft, thereby producing a lower $NPSH_R$ value for the multiple stage pump.

* * * * *